US010072438B2

(12) United States Patent
Skinner

(10) Patent No.: US 10,072,438 B2
(45) Date of Patent: Sep. 11, 2018

(54) BRIDGE FOR USE AT A GRAVE PIT DURING INTERMENT

(71) Applicant: Nelson Skinner, Hurricane, UT (US)

(72) Inventor: Nelson Skinner, Hurricane, UT (US)

( * ) Notice: Subject to any disclaimer, the term of this patent is extended or adjusted under 35 U.S.C. 154(b) by 0 days.

(21) Appl. No.: 15/667,625

(22) Filed: Aug. 2, 2017

(65) Prior Publication Data

US 2018/0038126 A1 Feb. 8, 2018

Related U.S. Application Data

(60) Provisional application No. 62/369,781, filed on Aug. 2, 2016.

(51) Int. Cl.
*E04H 13/00* (2006.01)
*A61G 19/00* (2006.01)

(52) U.S. Cl.
CPC ..... *E04H 13/001* (2013.01); *A61G 19/00* (2013.01)

(58) Field of Classification Search
CPC ..... A61G 19/00; E04H 13/001
USPC ..... 27/1, 26, 27, 30, 32–34
See application file for complete search history.

(56) References Cited

U.S. PATENT DOCUMENTS

| | | | | |
|---|---|---|---|---|
| 1,963,267 | A * | 6/1934 | Harder | A61G 19/00 27/26 |
| 2,018,277 | A * | 10/1935 | Moore | A61G 19/00 27/30 |
| 2,147,858 | A * | 2/1939 | Parker | E04H 13/001 27/30 |
| 2,201,057 | A * | 5/1940 | Smetana | A61G 19/00 27/26 |
| 2,249,687 | A * | 7/1941 | Eshleman | A61G 19/00 27/26 |
| 2,835,956 | A * | 5/1958 | Moore | A61G 19/00 27/32 |
| 9,009,934 | B1 * | 4/2015 | Eckhart | A61G 19/00 27/32 |
| 2009/0260204 | A1 * | 10/2009 | Courchesne | A61G 19/00 27/32 |
| 2012/0084953 | A1 * | 4/2012 | Herridge | A61G 19/00 27/32 |

* cited by examiner

*Primary Examiner* — William L Miller
(74) *Attorney, Agent, or Firm* — Gurr & Brande, PLLC; Robert A. Gurr

(57) ABSTRACT

A grave bridge has a first horizontal frame member and a second horizontal frame member, each horizontal frame member telescopically adjustable; at least one plank interposed between the first and second horizontal frame members, the at least one plank secured to each frame member, and wherein the at least one plank has an extension frame longitudinally extendable from underneath a platform of the at least one plank; and a plurality of jacks for elevating the first and second horizontal frame members, the jacks placed at opposing ends of each horizontal frame member.

13 Claims, 12 Drawing Sheets

Section A-A

Section B-B

BRIDGE FOR USE AT A GRAVE PIT DURING INTERMENT

CROSS-REFERENCE TO RELATED APPLICATIONS

This application claims the benefit of U.S. Provisional Application Ser. No. 62/369,781, filed on Aug. 2, 2016, which is incorporated herein by reference.

TECHNICAL FIELD

The present disclosure relates to gravesites and burials. In particular, the present disclosure relates to ramps and bridges for use during interment.

BACKGROUND

In the United States, and many other countries, a traditional burial involves placing a casket in a grave pit dug into a cemetery or other site. If using a vault, the grave pit will be dug and the vault either placed down in the pit before the funeral or will rest atop the grave pit for placement of the casket. Whether using a vault or not, typically several pallbearers will carry the casket to the grave pit and place it over the pit, where it can later be lowered into the ground. When the pallbearers reach the pit, they must be careful so as to not fall into the pit. Because the pit is wider than the casket, planks (either wood or metal) are usually placed lengthwise across the pit to allow the pallbearers to place the casket over the pit without falling into the pit. Likewise, mourners may desire to come forward and place flowers on the casket, and may use the planks as a means to get closer to the casket.

Unfortunately, the planks are often unstable and may not properly cover the pit. As such, pallbearers and mourners are at risk of falling into the pit. Further, the pit often remains uncovered, creating a hazard to people and pets. Therefore, there remains a need for a bridge for using at a gravesite during interment that reduces the risk of falling and that likewise adds to the beauty of the ceremony. The current disclosure seeks to solve these and other problems.

SUMMARY OF EXAMPLE EMBODIMENTS

In one embodiment, a grave bridge comprises a first horizontal frame member and a second horizontal frame member, each horizontal frame member telescopically adjustable; at least one plank interposed between the first and second horizontal frame members, the at least one plank secured to each frame member, and wherein the at least one plank comprises an extension frame longitudinally extendable from underneath a platform of the at least one plank; and a plurality of jacks for elevating the first and second horizontal frame members, the jacks placed at opposing ends of each horizontal frame member.

In one embodiment, a grave bridge comprises a first horizontal frame member and a second horizontal frame member, each horizontal frame member telescopically adjustable; at least one plank interposed between the first and second horizontal frame members, the at least one plank secured to each frame member; a plurality of jacks for elevating the first and second horizontal frame members, the jacks placed at opposing ends of each horizontal frame member; and one or more ramps coupled to the first and second horizontal frame members, the ramps extending longitudinally from the at least one plank. In one embodiment, a grave bridge comprises a plurality of decorative end posts for concealing the plurality of jacks. In one embodiment, the grave bridge comprises decorative rails coupling a first decorative end post on a first jack of a first horizontal member to a second decorative end post on a second jack of a second horizontal member.

DETAILED DESCRIPTION OF EXAMPLE EMBODIMENTS

Figure 1:
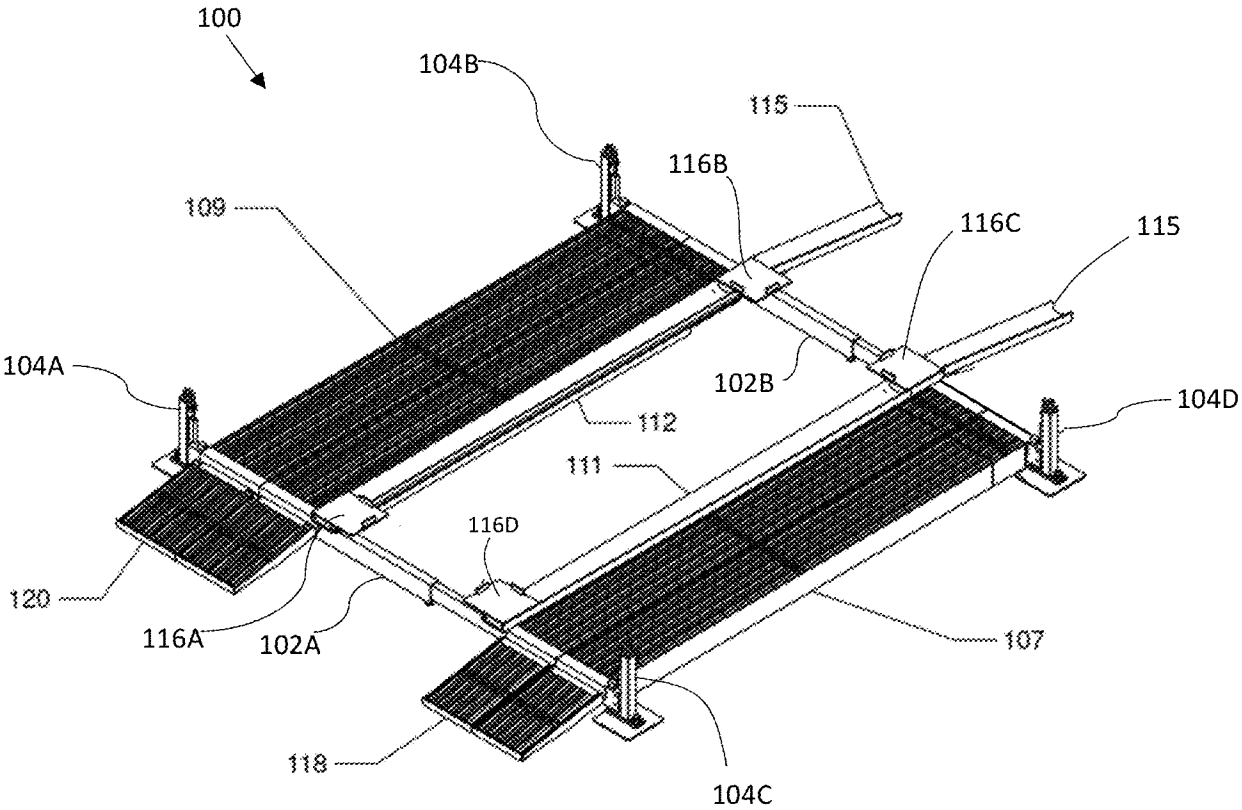
FIG. 1 is a perspective view of a grave bridge.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As disclosed herein, an adjustable grave bridge allows pallbearers and mourners to approach a grave pit without risk of falling in the pit. The grave bridge is horizontally adjustable to accommodate varying widths of grave pits, is longitudinally adjustable to accommodate varying lengths of grave pits, and is height-adjustable to compensate for uneven ground or raised vaults. The grave bridge may further have a pit cover, as well as decorative railing.

In one embodiment, as shown generally in FIG. 1, a grave bridge 100 comprises a first plank 107 and a second plank 109. The planks 107, 109 are preferably constructed of metal, steel, but may also be constructed of wood or other stable, weight-bearing materials. Further, the planks 107, 109 preferably have a non-slip surface. Each plank 107, 109 is coupled to horizontal frame members 102A, 102B. In one embodiment, each plank 107, 109 has an end configured to rest upon the horizontal frame members 102A, 102B. For example, an end of the plank 107, 109 may have a groove or bracket 114 (best seen in FIGS. 6-10) configured to receive the horizontal frame members 102A, 102B. In other words, the bracket 114 of a first end of plank 107 will rest upon horizontal frame member 102A while the bracket 114 of the second end of plank 107 rests upon horizontal frame member 102B. Coupled to the ends of each horizontal frame member 102A, 102B are jacks 104A, 104B, 104C, 104D for raising the horizontal frame members 102A, 102B. For example, if the ground is uneven, the jacks 104A-104D may be actuated accordingly, raising the horizontal frame member 102A, 102B accordingly, and thereby raising the planks 107, 109 to be at a level position. In another scenario, if a vault is resting atop the grave pit, the jacks 104A-104D may raise the planks 107, 109 to a better height for pallbearers and mourners. The grave bridge 100 may further comprise cart ramps 115, which are useful when using a casket lowering device. Cart ramps 115 are preferably removably attachable to horizontal frame member 102B, such as by using a bracket or groove (not shown, but similar to bracket 114) configured to rest on and receive the horizontal frame member 102B, or that couple to the planks 107, 109 by resting on a receiving lip 117 (best seen in FIGS. 6-10). Along with that, channels 111 and 112 and casket lowering device platforms 116A-116D are likewise useful when using a casket lowering device 121A, 121C (shown in FIG. 15). For example, each corner of the casket lowering device 121A, 121C (casket lowering device 121B and 121D are not visible) may rest upon the platforms 116A-116D. Further, the grave bridge 100 may further comprise ramps 118, 120, which are useful to provide a safe and easy means for users to approach the grave pit. It will also be appreciated that ramps 118 and 120 may be used on both ends of the planks 107, 109 and may be coupled to the horizontal frame members 102A, 102B or to the planks 107, 109 using tongue and groove (e.g., tongue resting on lip 117), brackets (equivalent to bracket 114), or other means.

Figure 2:
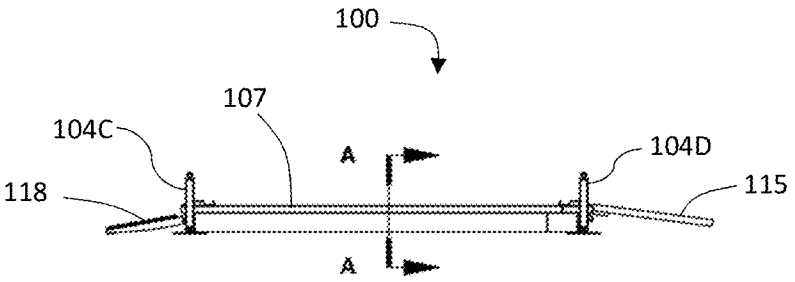
FIG. 2 is a side elevation view of a grave bridge.
Figure 3:
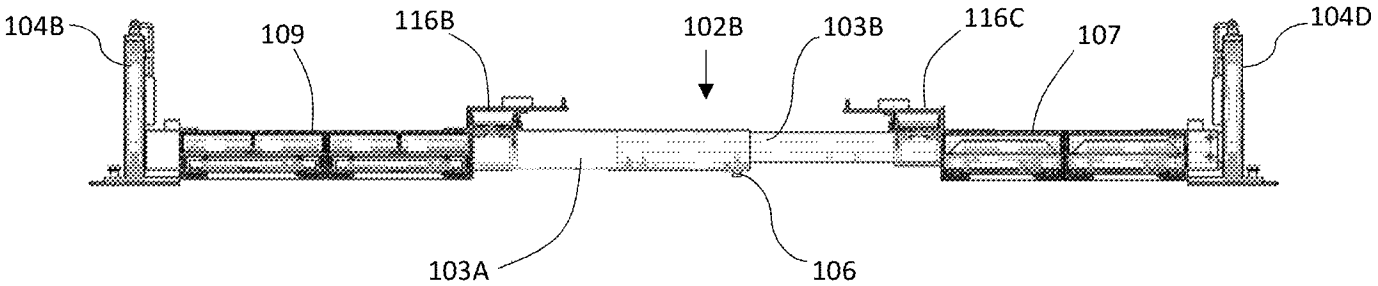
FIG. 3 is a sectional view along lines A-A of a grave bridge.
Figure 4:
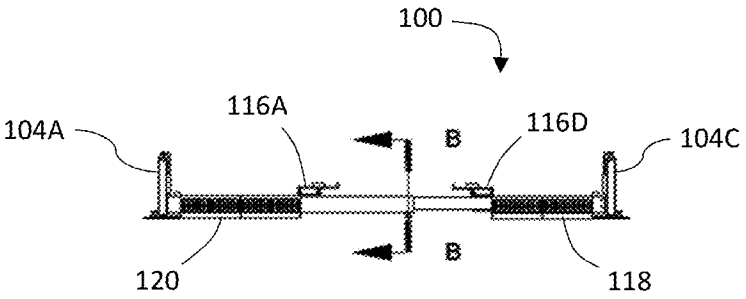
FIG. 4 is a front elevation view of a grave bridge.
Figure 5:
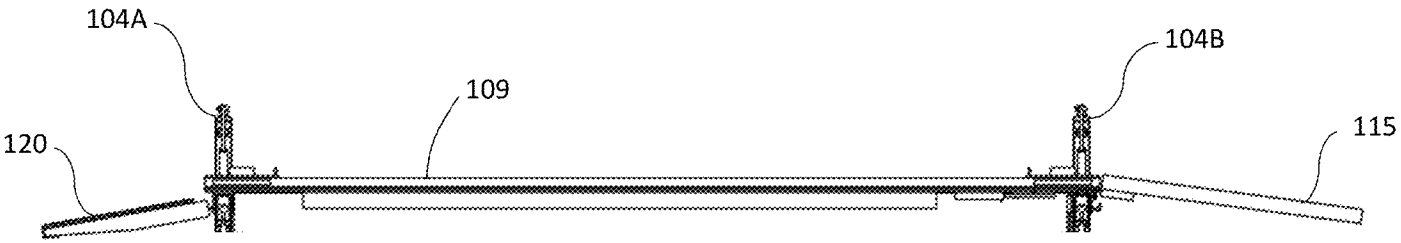
FIG. 5 is a sectional view along lines B-B of a grave bridge.
Figure 6:
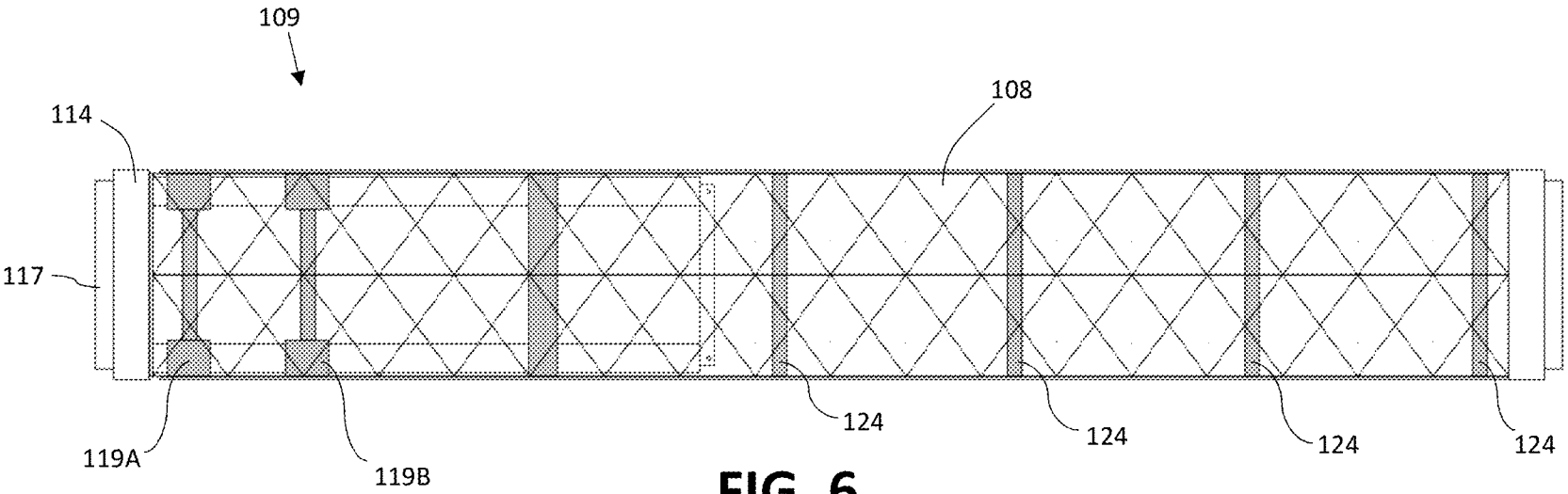
FIG. 6 is a top plan view of a plank of a grave bridge.
Figure 7:
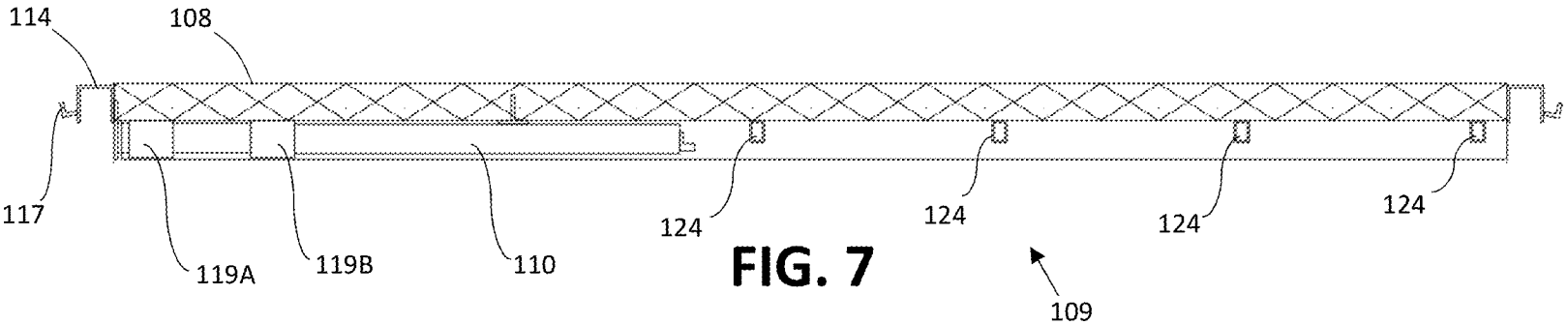
FIG. 7 is a side elevation view of a plank of a grave bridge.
Figure 8:
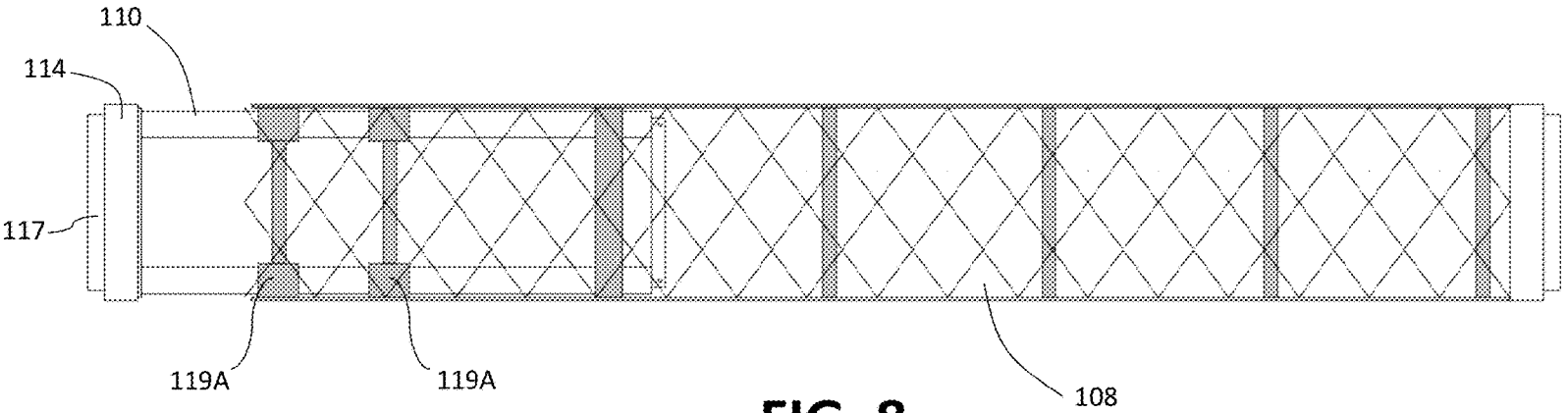
FIG. 8 is a top plan view of a plank with an extension frame extended longitudinally therefrom of a grave bridge.
Figure 9:
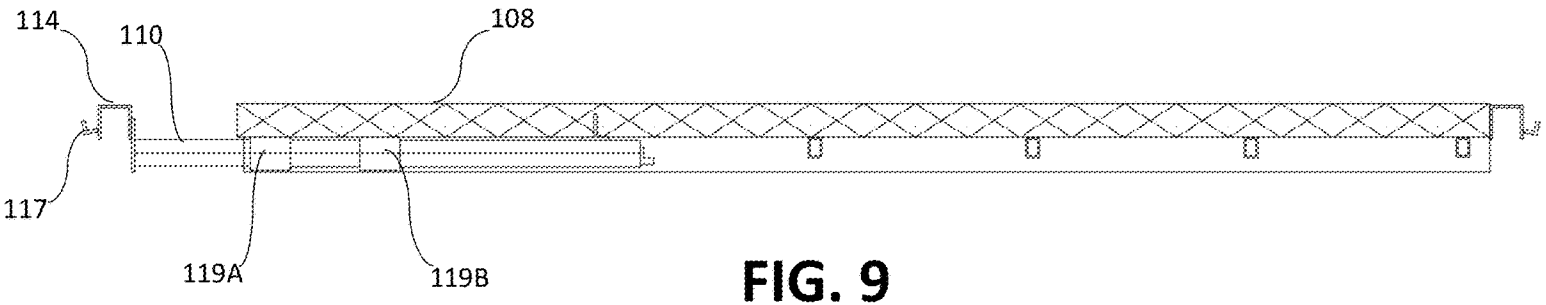
FIG. 9 is a side elevation view of a plank with an extension frame extended longitudinally therefrom of a grave bridge.
Figure 15:
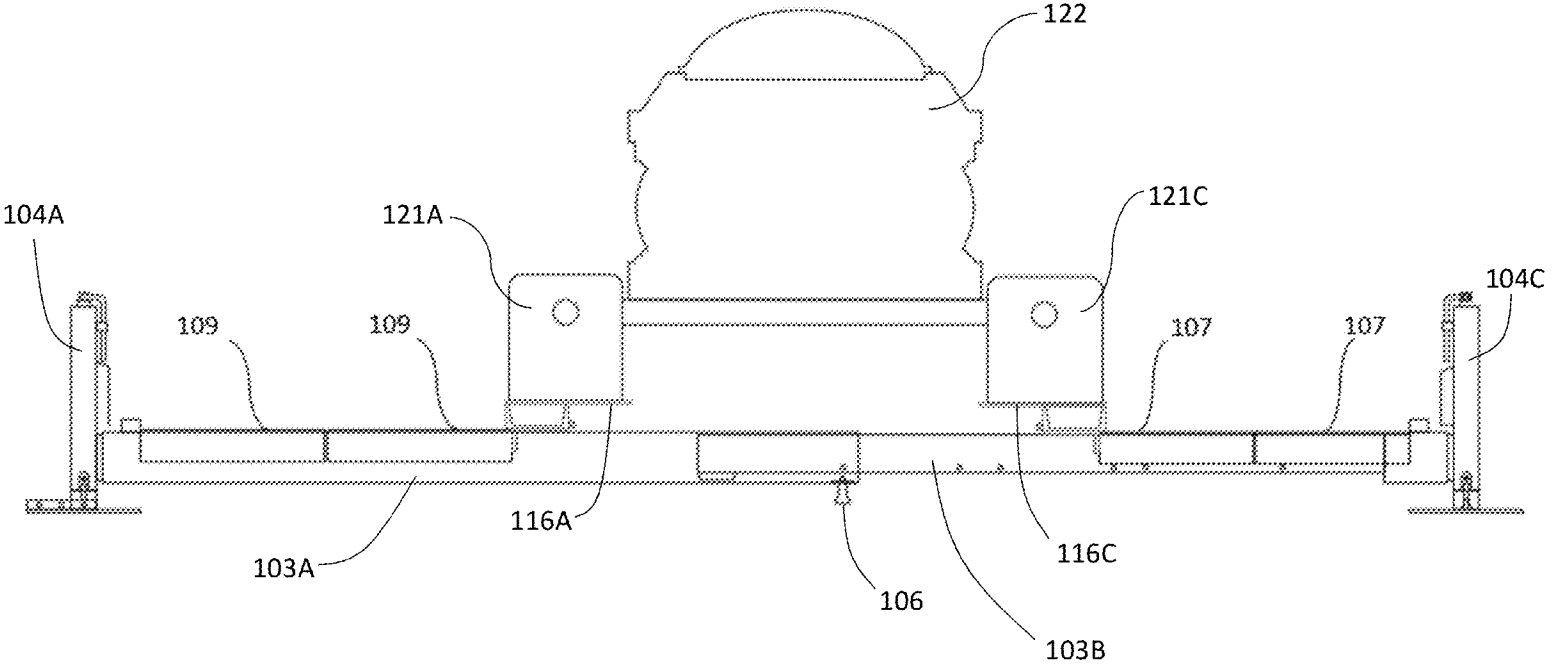
FIG. 15 is a front elevation view of a grave bridge with a casket thereon.
Figure 16:
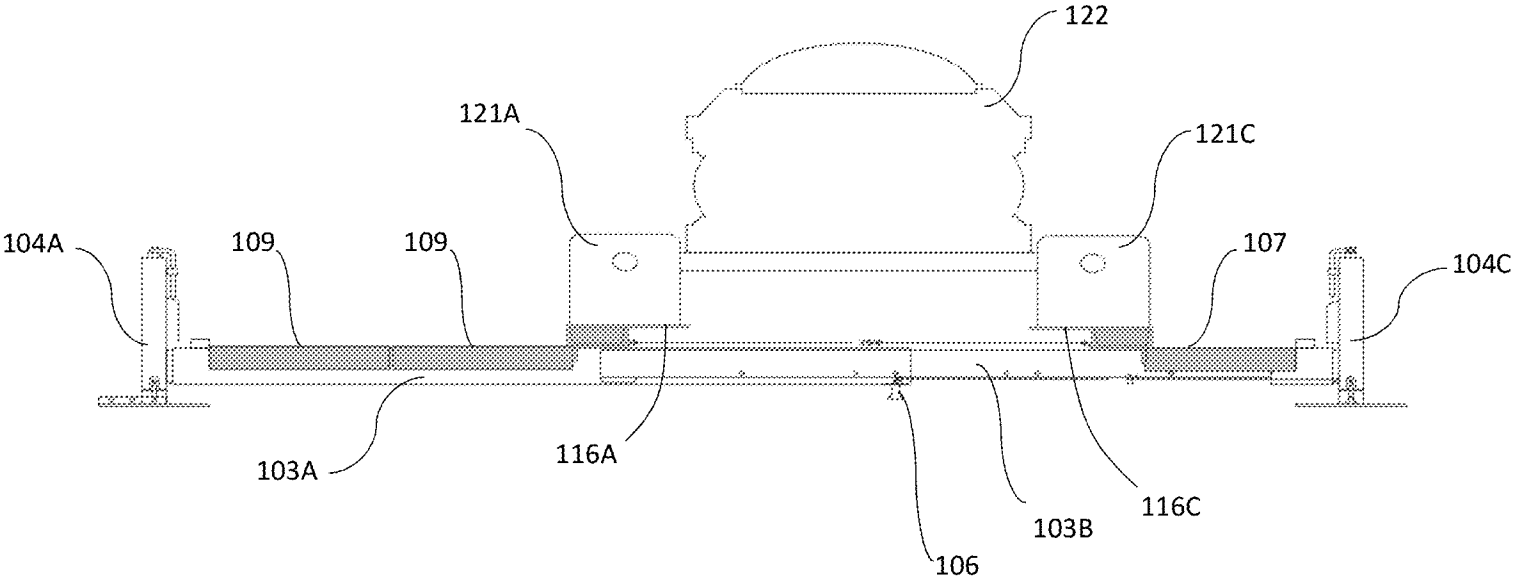
FIG. 16 is a front elevation view of a grave bridge with a casket thereon.
Figure 17:
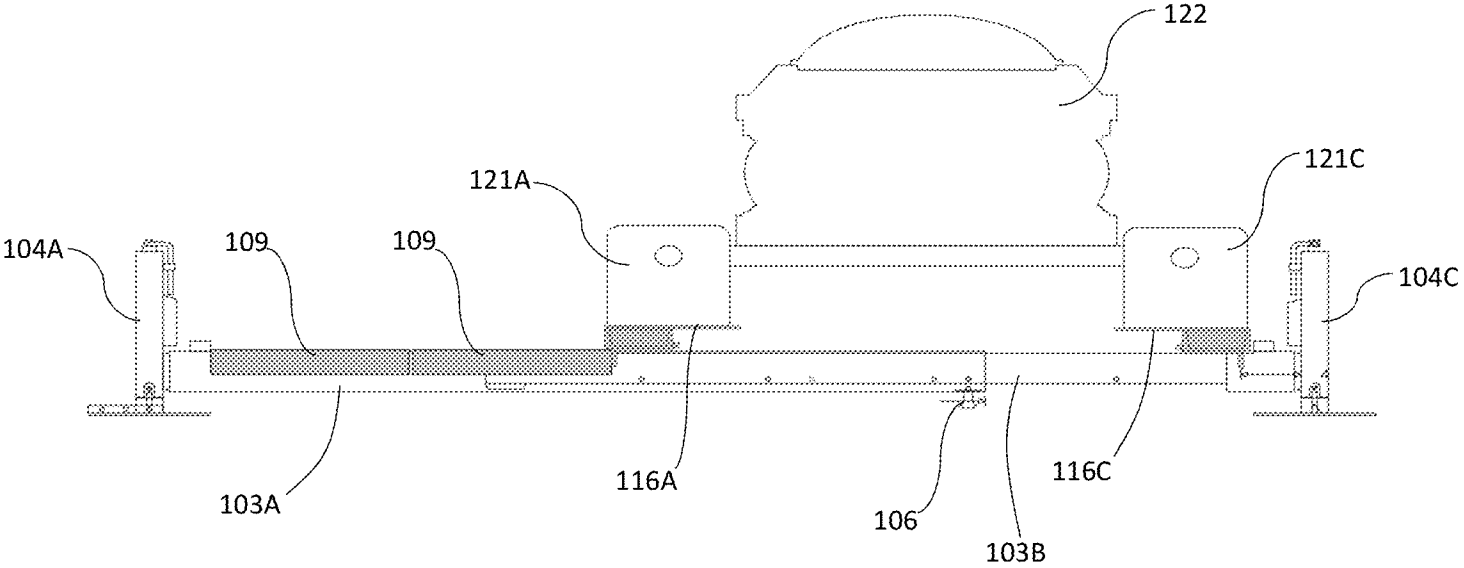
FIG. 17 is a front elevation view of a grave bridge with a casket thereon.

FIG. 2 illustrates a right, side elevation view of a grave bridge 100. FIG. 3 is a cross-section along lines A-A of FIG. 2. As shown in FIG. 3, horizontal frame member 102B is horizontally adjustable using a telescoping means. In other words, horizontal frame member 102B comprises a female member 103A and a male member 103B configured to be received, and is slidable, within the female member 103A. A locking pin 106 interlocks the female member 103A and male member 103B so that it remains at a user-selected width. A plurality of apertures (not visible) may run along the bottom of the male member 103B, the apertures configured to receive the locking pin 106. It will be appreciated that locking pin 106 may be spring loaded, but that other mechanisms may likewise be used, such as a bolt, screw, cotter pin, or similar. Being able to widen the grave bridge 100 is important, as grave pits are not all of the same width. Accordingly, being able to adjust both the width and length (described later herein) is important. In some instances, the grave pit may be dug substantially wider than the casket. In such a scenario, it is difficult to properly place the casket on the casket lowering device. Currently in the art, wooden or metal planks may be placed on the ground to span the opening. However, this is extremely dangerous, as the planks are not secured to the ground and may move when individuals walk thereon, or may not be able to properly bear weight of several individuals. Further, if more than one plank is used, gaps may form between the planks, which makes people susceptible to falling therein or otherwise tripping. To overcome this problem, the grave bridge 100 disclosed herein may be widened using the telescoping method described above with the horizontal frame members 102A, 102B. Once widened, additional planks 107, 109 may be placed thereon, ensuring that no gap exists between the casket and the ground. FIGS. 15-17 illustrate several configurations with a plurality of planks 107, 109 being used. It will be appreciated that multiple planks 107, 109 may be used on one or both sides of the casket 122, and that the planks 107, 109 may not all be of the same width. This allows a user to customize the placement of the casket 122 over the grave pit accordingly.

Figure 10:
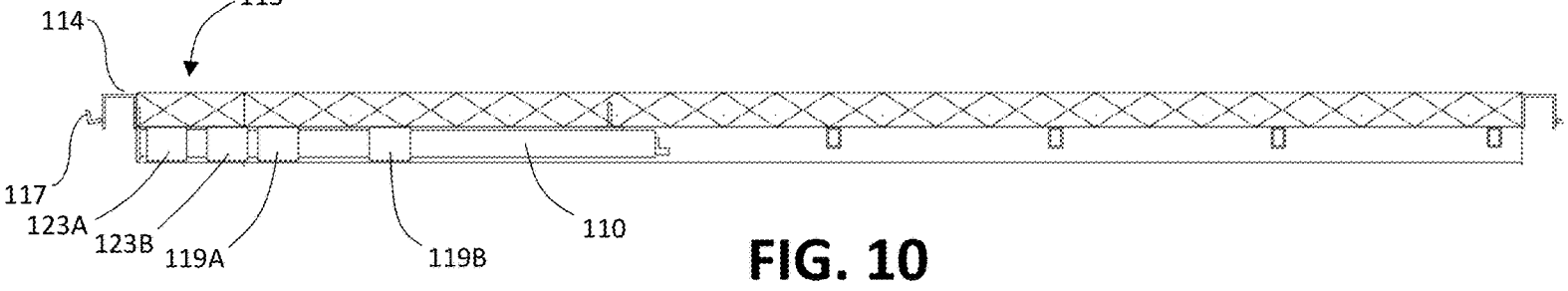
FIG. 10 is a side elevation view of a plank with an extension frame extended longitudinally therefrom and having an extension platform thereon of a grave bridge.
Figure 12:
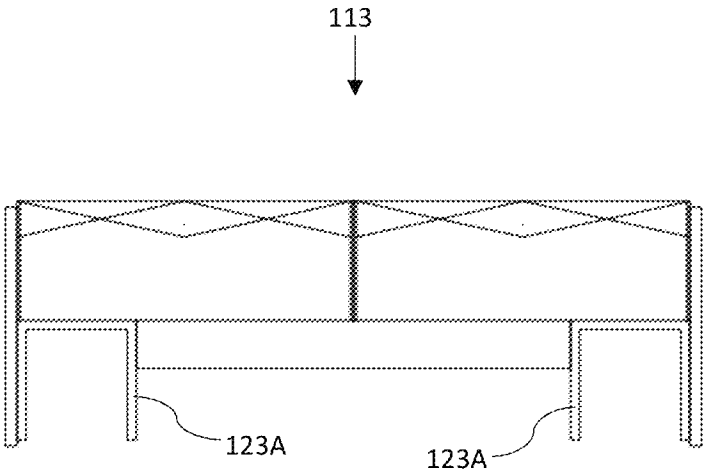
FIG. 12 is a front elevation view of an extension platform of a grave bridge.
Figure 11:
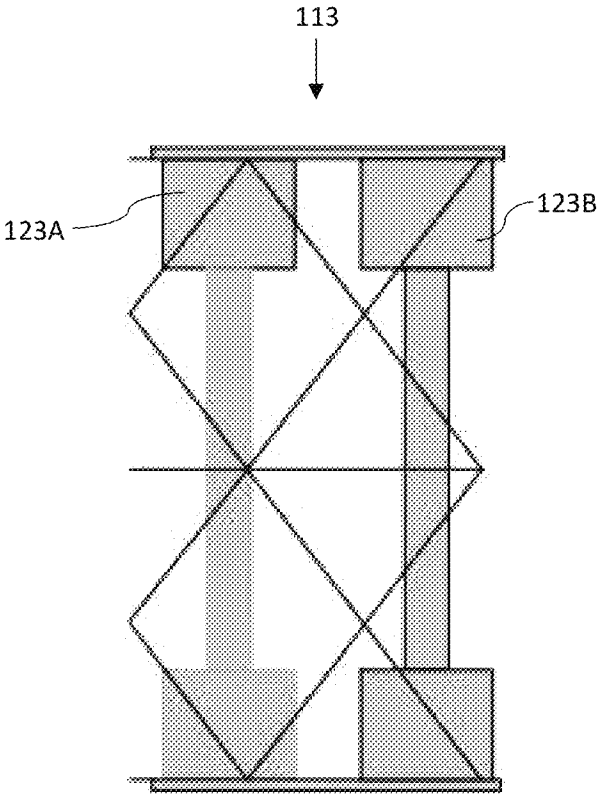
FIG. 11 is a top plan view of an extension platform of a grave bridge.

As shown in FIGS. 6-10, each plank 107, 109 is longitudinally adjustable to accommodate different lengths of grave pits. Plank 109 has a platform 108, cross-beams 124, and an extension frame 110, with extension platforms 113 placed on the extension frame 110 as it is lengthened. As shown, the extension frame 110 is coupled to the platform 108 via securing brackets 119A, 119B. The extension frame 110 is slidable within the securing brackets 119A, 119B, allowing the extension frame 110 to be extended longitudinally from the platform 108. It will be appreciated that rather than the entire support frame 110 being moveable, it may be configured telescopically as well, such that the ends telescope outwardly (e.g., male rods extending from female receiving apertures in extension frame 110). Accordingly, if a longer platform 108 is needed to span the length of the grave pit, a user would slide the extension frame 110 through securing brackets 119A, 119B from underneath the platform 108, creating space for one or more extension platforms 113 to be placed thereon and secured using extension brackets 123A, 123B, as shown in FIG. 10.

Figure 14:
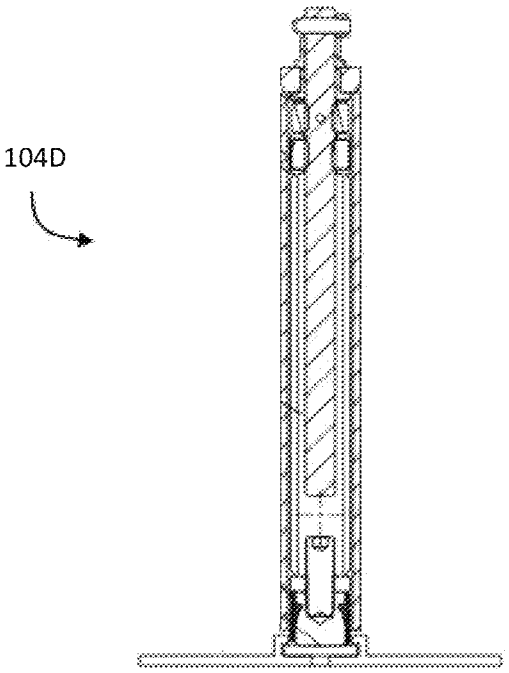
FIG. 14 is a cross-section of a jack of a grave bridge.
Figure 13:
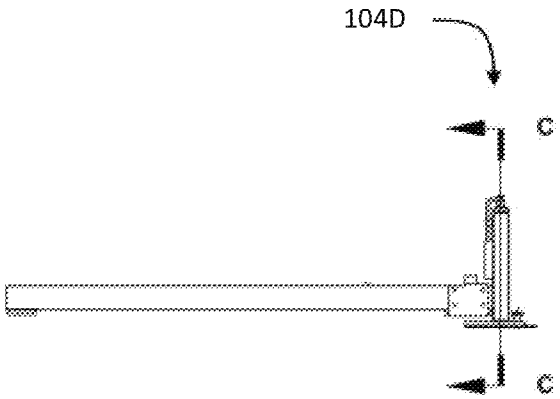
FIG. 13 is a detailed, side-elevation view of a plank and jack of a grave bridge.

As mentioned earlier, grave bridge 100 comprises a plurality of jacks 104A-104D. FIGS. 13-14 show the jacks 104A-104D in more detail. Because each jack 104A-104D is separate from the others, each may be actuated independently to achieve level planks 107, 109 even when on uneven ground. Jacks 104A-104D may be any number of well-known jacks in the industry, including screw-type, hydraulic, scissor, or other.

Figure 18:
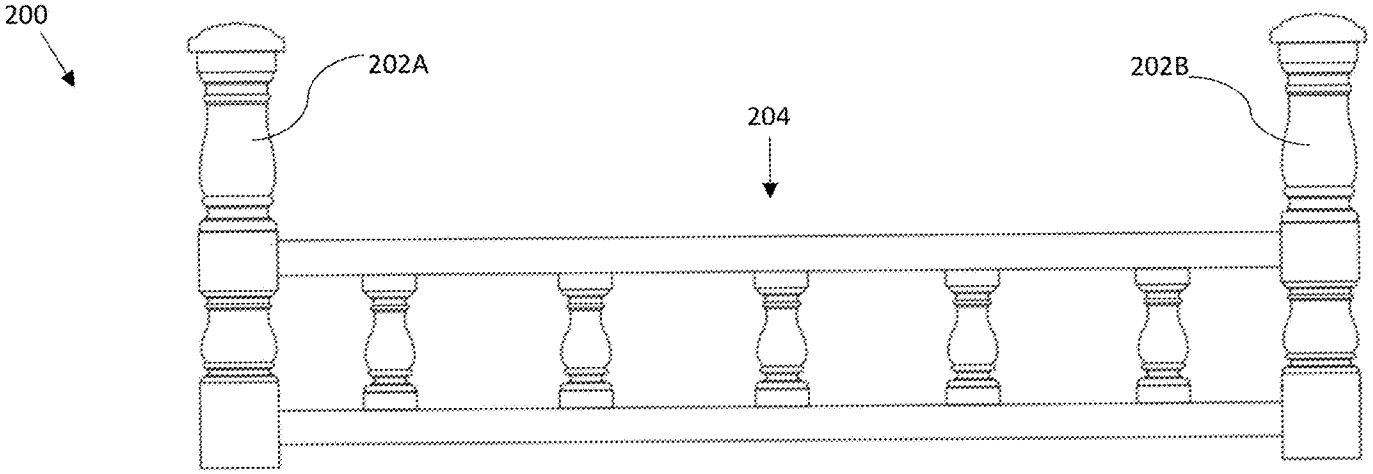
FIG. 18 is a side elevation view of decorative railing of a grave bridge.
Figure 19:
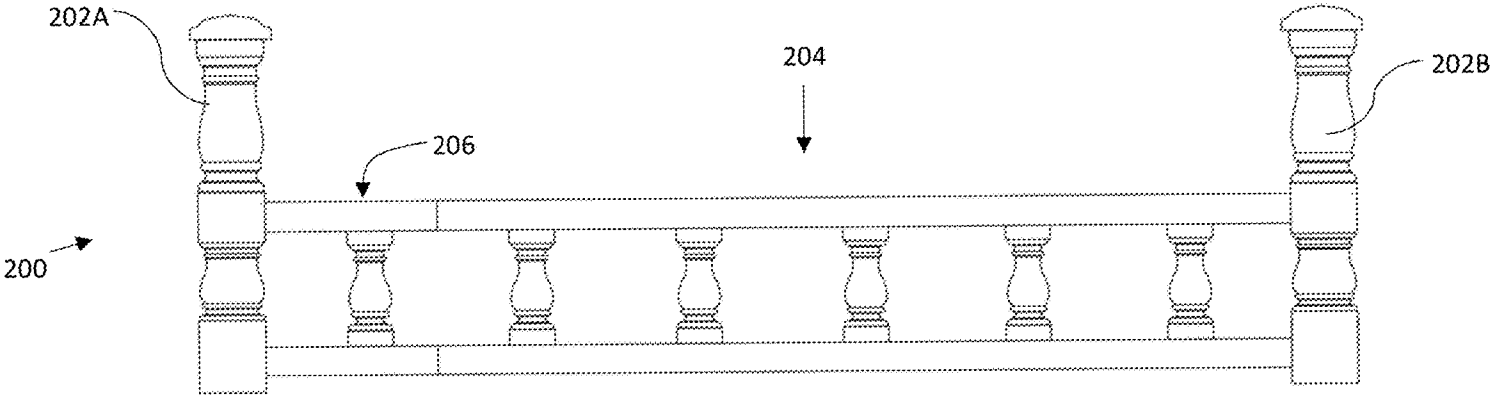
FIG. 19 is a side elevation view of a decorative railing of a grave bridge with an extension.
Figure 20:
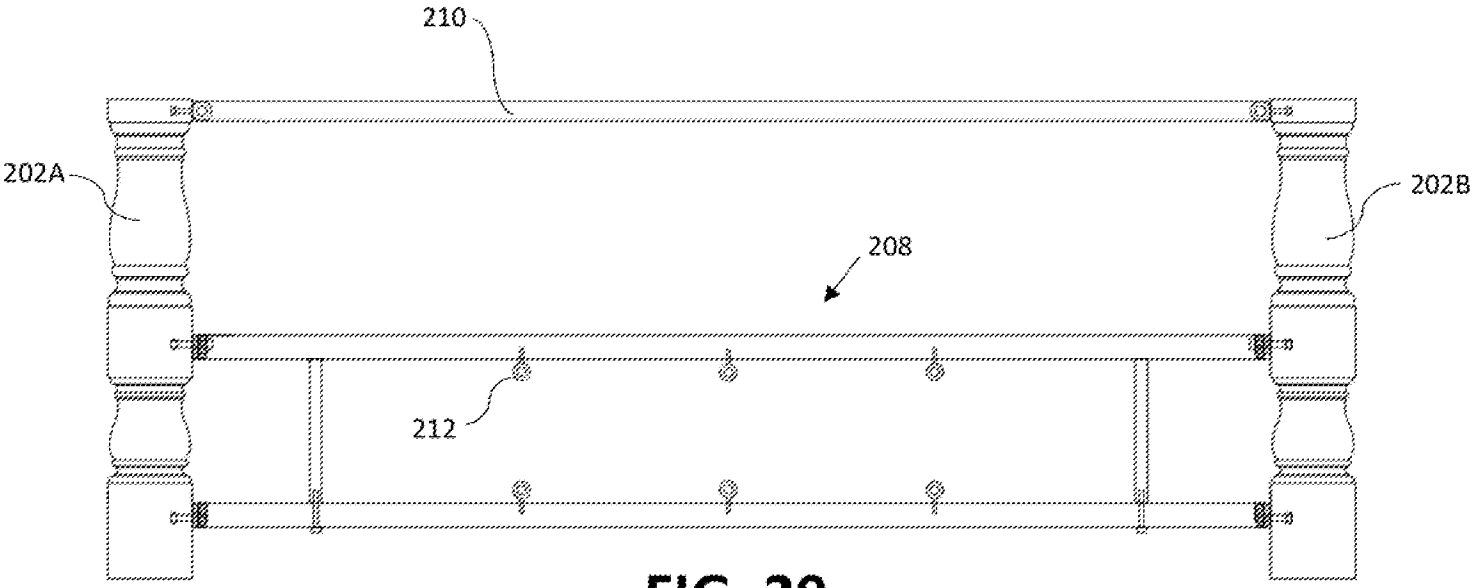
FIG. 20 is a side elevation view of a decorative railing of a grave bridge with a hand rail.
Figure 21:
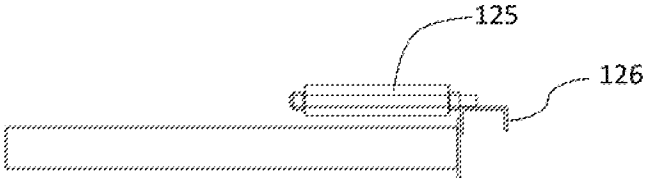
FIG. 21 is a side elevation view of a roller attachment of a grave bridge.

As shown in FIGS. 18-19, a grave bridge may comprise decorative fencing 200. The decorative fencing 200 comprises decorative end posts 202A, 202B with a decorative rail portion 204 interposed therebetween. In order to maintain the decorative look when the planks 107, 109 are extended, one or more rail extensions 206 may be used. Further, the decorative end posts 202A, 202B may be hollow and configured to receive and thereby conceal the jacks 104A-104D therein. In such a configuration, the funeral goers are presented with a decorative look, rather than a utilitarian look. FIG. 20 is another example of decorative fencing 200 comprising end posts 202A, 202B, a coupling frame 208, and a handrail 210. Decorations, adornments, or other items may be fastened to the coupling frame 208, such as by using eye bolts 212. Coupling frame 208 may be interposed between the first and second end posts 202A, 202B using bolts, screws, tongue and groove connectors, or any equivalent.

FIG. 20 illustrates a side elevation view of a roller 125 (e.g., bearing rotatable) and bracket 126. A plurality of brackets may be coupled to one or more planks 107, 109 or to channels 111, 112. Accordingly, a casket or vault may be placed on the rollers 125, which are over the grave pit. A user may then slide the vault or casket on the rollers 125 as needed to ensure that the vault or casket is centered over the pit.

Accordingly, in one example of use, a user would place horizontal frame member 102A at a first end of the grave pit and lengthen it using telescoping female and male members 103A, 103B, respectively, and locking pin 106, to ensure that it spans the width of the grave pit. The user would then place the second horizontal frame member 102B at the opposite end of the grave pit and likewise adjust it to properly match the width of the first horizontal frame member 102A. A user would then place a plank 107, 109 lengthwise along the length of the grave pit to ensure that it is the proper length. If it needs to be lengthened, a user would longitudinally extend the extension frame 110 so that the plank 107, 109 may properly span the length of the grave pit and engage (via bracket 114) the first and second horizontal frame members 102A, 102B. A user then places the planks 107, 109 on the first and second horizontal frame members 102A, 102B accordingly, and may additionally place any extension platforms 113 that may be needed to ensure complete coverage of the length of the grave pit. If a casket lowering device will be used, a user may further place channels 111 and 112 and casket lowering device platforms 116A-116D proximal to the edge of the innermost planks 107, 109. If the planks 107, 109 are not level due to uneven ground, or if the height of the planks 107, 109 otherwise needs to be raised, a user may actuate one or more of the jacks 104A-104D to the desired height. In order to avoid tripping on the horizontal frame members 102A, 102B, ramps 118, 120 may be coupled thereto. This is accomplished by engaging a first end of the ramp 118, 120 with a receiving lip 117 on the end of the planks 107, 109. The ramps 118, 120 may have a tongue that rests in receiving lip 117. With the utility aspect of the grave bridge 100 assembled, as shown in FIG. 1, a user may then desire to make the grave bridge 100 more aesthetically pleasing. Therefore, a user may place a first decorative end post 202A over a first jack 104A and a second decorative end post 202B over a second jack 104B. A user may then couple the first end post 202A to the second end post 202B using decorative rail portions 204. They may be coupled using screws, bolts, tongue and groove connectors, or any other number of connectors. This process may then be repeated on the opposite side of the grave pit. Handrail 210 may also be coupled, providing safety to a user. In one embodiment, a pit covering (not shown) may also be used. The pit covering is a durable material that may be on a roller, the roller being placed in receiving brackets that are coupleable to horizontal frame member 102B. The pit covering may then be pulled across the pit and fastened to horizontal frame member 102A using snaps, hooks, loops, or any other removably attachable securing mechanism. The pit covering helps to prevent people from peering into the grave pit and likewise helps to prevent animals or people from falling into the pit. The roller may be a rod with the pit covering wrapped around it.

Therefore, it is clear that the grave bridge disclosed herein solves several problems in the art. Namely, not only does the gravesite look much more presentable to grieving individuals, but is also adds several layers of safety. In other words, the planks 107, 109 prevent a person from falling in the pit, tripping, or otherwise getting injured. Likewise, the decorative fencing 200 prevents a person from accidentally stepping off the planks 107, 109 or otherwise falling therefrom. Further, it provides a handrail 210 to persons in need. The planks 107, 109 also make the grave pit accessible to handicapped individuals. For example, those in a wheelchair may easily approach the casket using the ramps 118, 120 and planks 107, 109. Individuals who struggle to walk, such as the elderly or infirm, may also utilize the handrail 210.

Therefore, it is appreciated from the foregoing that the grave bridge disclosed herein allows pallbearers and mourners to approach a grave pit without risk of falling in the pit, is horizontally adjustable to accommodate varying widths of grave pits, is longitudinally adjustable to accommodate varying lengths of grave pits, and is height-adjustable to compensate for uneven ground or raised vaults. Lastly, the grave bridge is aesthetically pleasing.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention as defined in the appended claims. Additionally, it is not intended that the scope of patent protection afforded the present invention be defined by reading into any claim a limitation found herein that does not explicitly appear in the claim itself.

What is claimed is:

1. A grave bridge, comprising:

a first horizontal frame member and a second horizontal frame member, each horizontal frame member telescopically adjustable;

at least one plank interposed between the first and second horizontal frame members, the at least one plank secured to each frame member, and wherein the at least one plank comprises an extension frame longitudinally extendable from underneath a platform of the at least one plank; and a plurality of jacks for elevating the first and second horizontal frame members, the jacks placed at opposing ends of each horizontal frame member.

2. The grave bridge of claim 1, further comprising a plurality of decorative end posts for concealing the plurality of jacks.

3. The grave bridge of claim 2, further comprising decorative rails coupling the first decorative end post on the first jack of the first horizontal member to the second decorative end post on the second jack of the second horizontal member.

4. The grave bridge of claim 1, further comprising a plurality of casket lowering device platforms.

5. The grave bridge of claim 4, further comprising two channels, each channel proximal to the innermost edge of the innermost plank and secured between a first casket lowering platform on the first horizontal member and a second horizontal lowering platform on the second horizontal frame member.

6. A grave bridge, comprising:

a first horizontal frame member and a second horizontal frame member, each horizontal frame member telescopically adjustable;

at least one plank interposed between the first and second horizontal frame members, the at least one plank secured to each frame member;

a plurality of jacks for elevating the first and second horizontal frame members, the jacks placed at opposing ends of each horizontal frame member; and one or more ramps coupled to the first and second horizontal frame members, the ramps extending longitudinally from the at least one plank.

7. The grave bridge of claim 6, wherein the plank comprises a platform and an extension frame, the extension frame coupled to the platform using one or more brackets and wherein the extension frame is slidable in the brackets so as to be longitudinally extended from underneath the platform.

8. The grave bridge of claim 6, further comprising a plurality of decorative end posts for concealing the plurality of jacks.

9. The grave bridge of claim 8, further comprising decorative rails coupling the first decorative end post on the first jack of the first horizontal member to the second decorative end post on the second jack of the second horizontal member.

10. The grave bridge of claim 6, further comprising a plurality of casket lowering device platforms.

11. The grave bridge of claim 10, further comprising two channels, each channel proximal to the innermost edge of the innermost plank and secured between a first casket lowering platform on the first horizontal member and a second horizontal lowering platform on the second horizontal frame member.

12. A grave bridge, comprising:

a first horizontal frame member and a second horizontal frame member, each horizontal frame member telescopically adjustable;

at least one plank interposed between the first and second horizontal frame members, the at least one plank secured to each frame member using a bracket, and wherein the at least one plank comprises an extension frame longitudinally extendable from underneath a platform of the at least one plank;

a plurality of jacks for elevating the first and second horizontal frame members, the jacks placed at opposing ends of each horizontal frame member;

one or more ramps coupled to the at least one plank, the ramps extending longitudinally from the at least one plank;

a plurality of decorative end posts for receiving and concealing the plurality of jacks; and a handrail interposed between two decorative end posts.

13. The grave bridge of claim 12, further comprising a pit covering extendable from a roller, the roller being coupled to the first horizontal frame member and wherein the pit covering is extendable and attachable to the second horizontal frame member.

* * * * *